US008579337B2

(12) United States Patent
Hidding et al.

(10) Patent No.: US 8,579,337 B2
(45) Date of Patent: Nov. 12, 2013

(54) FREE FLOATING PADDLE HANDLE FOR VEHICLE DOORS

(75) Inventors: Matthew L. Hidding, Elma, IA (US); Toby Schwickerath, New Hampton, IA (US)

(73) Assignee: Trimark Corporation, New Hampton, IA (US)

( * ) Notice: Subject to any disclaimer, the term of this patent is extended or adjusted under 35 U.S.C. 154(b) by 905 days.

(21) Appl. No.: 12/693,778

(22) Filed: Jan. 26, 2010

(65) Prior Publication Data

US 2011/0181055 A1 Jul. 28, 2011

(51) Int. Cl.
*E05C 9/16* (2006.01)
*E05C 9/10* (2006.01)

(52) U.S. Cl.
USPC ..... 292/48; 292/35; 292/126; 292/166; 292/DIG. 27; 292/DIG. 31; 70/208; 70/264; 70/472

(58) Field of Classification Search
USPC ..... 70/205, 207–210, 224, 264, 467, 472, 70/489, 192, 202, 218, 237, 238, 432, 70/DIG. 31, DIG. 42, DIG. 67; 292/3–13, 292/336.3, 26, 29, 30, 34–36, 40, 41, 46, 292/48, 52, 53, 97, 100, 123, 126, 127, 139, 292/143, 158, 165–168, 173, 174, 196, 200, 292/217, 221, 223, 227, DIG. 25, DIG. 27, 292/DIG. 31, DIG. 62
See application file for complete search history.

(56) References Cited

U.S. PATENT DOCUMENTS

| | | | | |
|---|---|---|---|---|
| 4,320,642 | A | 3/1982 | Pastva, Jr. | |
| 4,892,338 | A * | 1/1990 | Weinerman et al. | 292/35 |
| 4,896,906 | A * | 1/1990 | Weinerman et al. | 292/48 |
| 4,917,412 | A * | 4/1990 | Swan et al. | 292/48 |
| 4,951,486 | A * | 8/1990 | Braun et al. | 70/208 |
| 5,042,853 | A * | 8/1991 | Gleason et al. | 292/126 |
| 5,069,491 | A * | 12/1991 | Weinerman et al. | 292/48 |
| 5,117,665 | A * | 6/1992 | Swan et al. | 70/264 |
| 5,174,619 | A | 12/1992 | Bender et al. | |
| 5,299,844 | A * | 4/1994 | Gleason | 292/240 |
| 5,595,076 | A * | 1/1997 | Weinerman et al. | 70/208 |
| 5,820,174 | A * | 10/1998 | Parikh et al. | 292/126 |
| 5,941,104 | A | 8/1999 | Sadler | |
| 6,490,895 | B1 * | 12/2002 | Weinerman et al. | 70/208 |

(Continued)

OTHER PUBLICATIONS

"Slam Latches/Multi-Points/20000 series", Eberhard Manufacturing, catalog page, http://eberhard.com/slam-latches.multi-points120000-series/prod_163.html. page printed Oct. 26, 2009.

*Primary Examiner* — Carlos Lugo
*Assistant Examiner* — Alyson M Merlino
(74) *Attorney, Agent, or Firm* — McKee, Voorhees & Sease, P.L.C.

(57) ABSTRACT

A handle assembly is provided for a vehicle passenger door or compartment door and has a free floating paddle when the door or compartment is locked. The paddle is pivotally mounted on the exterior of the handle housing, while a logic assembly is mounted on the interior of the housing. The logic assembly includes a pivotal drive plate, a pivotal driven plate, and a pivotal lock arm. The drive plate is independent of the driven plate when the door is locked. The drive plate and driven plate moving in unison when the door is unlocked and the paddle is opened, thereby opening the latch mechanism for the vehicle compartment.

15 Claims, 9 Drawing Sheets

(56) References Cited

U.S. PATENT DOCUMENTS 6,513,353 B1 2/2003 Weinerman et al.
6,543,821 B1 * 4/2003 Weinerman et al. ..... 292/123
6,629,711 B1 10/2003 Gleason et al.
6,708,537 B1 3/2004 Eschweiler et al.
6,854,304 B2 * 2/2005 Linares ..... 70/208
7,921,685 B2 * 4/2011 Teskey ..... 70/208

* cited by examiner

FREE FLOATING PADDLE HANDLE FOR VEHICLE DOORS

BACKGROUND OF THE INVENTION

Paddle-type door handles are well known for opening a door latch mechanism in various types of vehicles, including automobiles, industrial vehicles, utility vehicles, commercial vehicles and recreational vehicles. Typically, the paddle handle is mounted on the outside of the door, which may be a passenger door or a compartment door. The handle is connected to the latch mechanism through one or more linkages so as to release the latch and open the door. Many handles are provided with a lock to preclude unauthorized entry into the vehicle or the compartment. Normally, when the door is locked, the paddle handle does not move. However, some users mistakenly believe that the locked handle is merely stuck, and pull harder on the paddle in an attempt to open the door, which may lead to breakage of one or more components of the paddle handle.

Therefore, a primary objective of the present invention is the provision of an improved paddle handle assembly for a vehicle which is free floating when the door is locked.

Another objective of the present invention is the provision of a free floating paddle handle assembly having a drive plate and a driven plate which operate independently when the door is locked and which operate in unison when the door is unlocked.

A further objective of the present invention is the provision of an improved paddle handle assembly wherein a lock arm moves between locked and unlocked positions so as to disengage and engage actuation plates operatively interconnecting the paddle with the latch mechanism.

Another objective of the present invention is the provision of an exterior paddle handle assembly which can be operatively coupled to an interior handle assembly, with both handle assemblies being linked to the door latch mechanism.

Yet another objective of the present invention is the provision of a paddle handle assembly which is economical to manufacture and durable and safe in use.

These and other objectives will become apparent from the following description of the invention.

BRIEF SUMMARY OF THE INVENTION

An improved paddle handle assembly is provided for a vehicle door having a latch mechanism movable between open and closed positions. The handle assembly includes a housing with interior and exterior sides, and a paddle pivotally mounted on the exterior of the housing for movement between open and closed positions. A logic assembly is mounted on the interior side of the housing. The logic assembly includes a drive plate and a driven plate, both of which are pivotally mounted on the housing. The driven plate is connected to the latch mechanism by linkage arms. A lock arm is also pivotally mounted on the interior of the housing for movement between locked and unlocked positions. The drive plate is disengaged from the driven plate when the lock arm is in a locked position, such that the latch mechanism remains closed when the paddle is moved to the open position. Thus, when the lock arm is locked, the paddle free floats. The drive plate is engaged with the driven plate when the lock arm is in the unlocked position, so as to open the latch mechanism when the paddle is moved to the open position. Thus, the drive plate operates independently of the driven plate when the lock arm is in the locked position so as to preclude opening of the latch mechanism, and the drive and driven plates operate in unison when the lock arm is in the unlocked position so as to open the latch mechanism.

DETAILED DESCRIPTION OF THE PREFERRED EMBODIMENTS

Figure 1:
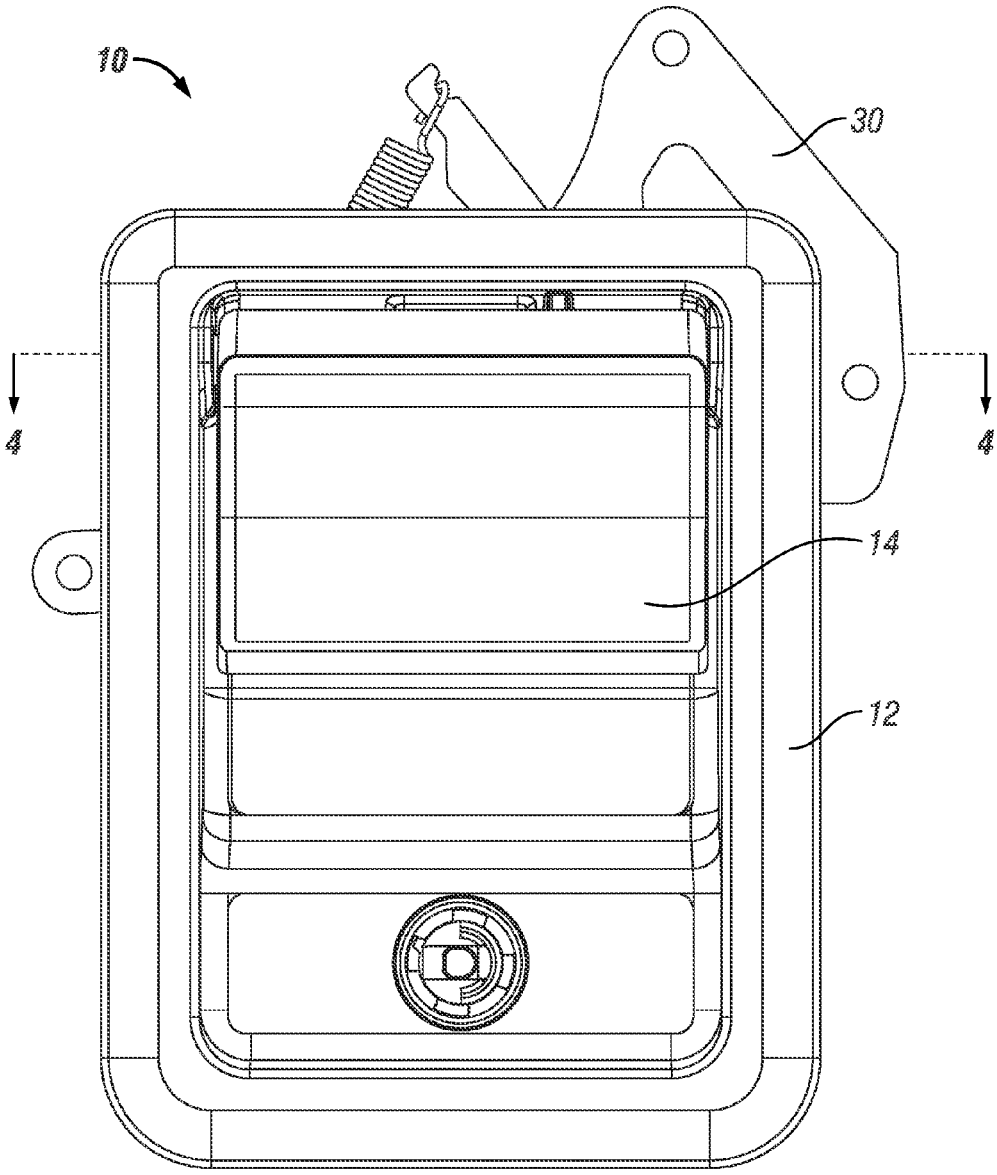
FIG. 1 is a front elevation view of the improved paddle handle assembly of the present invention.
Figure 2:
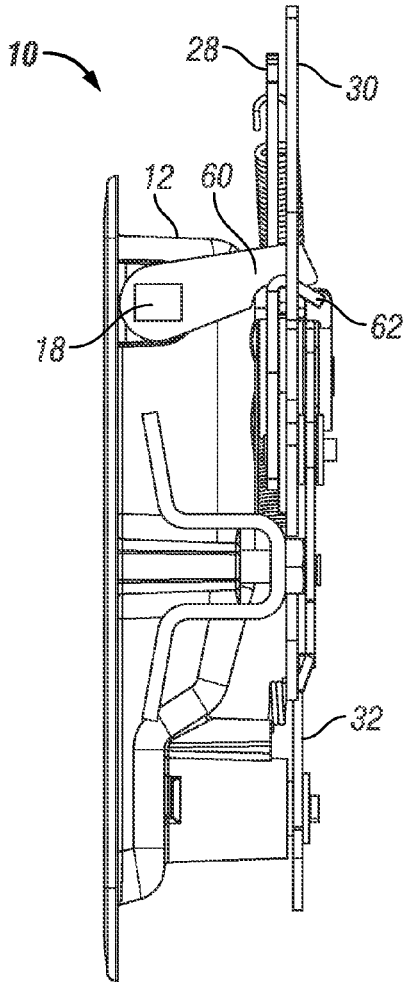
FIG. 2 is a side elevation view taken along the right side of FIG. 1.

The free floating paddle handle assembly of the present invention is generally designated in the drawings by the reference numeral 10. The handle assembly 10 includes a housing 12, a paddle 14 pivotally mounted to the housing for movement between open and closed positions, and a logic assembly 16 mounted on the rear or interior side of the housing 12. The handle assembly 10 is intended for, but not limited to, use on the outside or exterior of a vehicle door to provide access to the interior of the vehicle or a vehicle compartment. As described below, the handle assembly 10 is operatively connected to the latch mechanisms of the vehicle which allow the door to be opened and closed.

Figure 6:
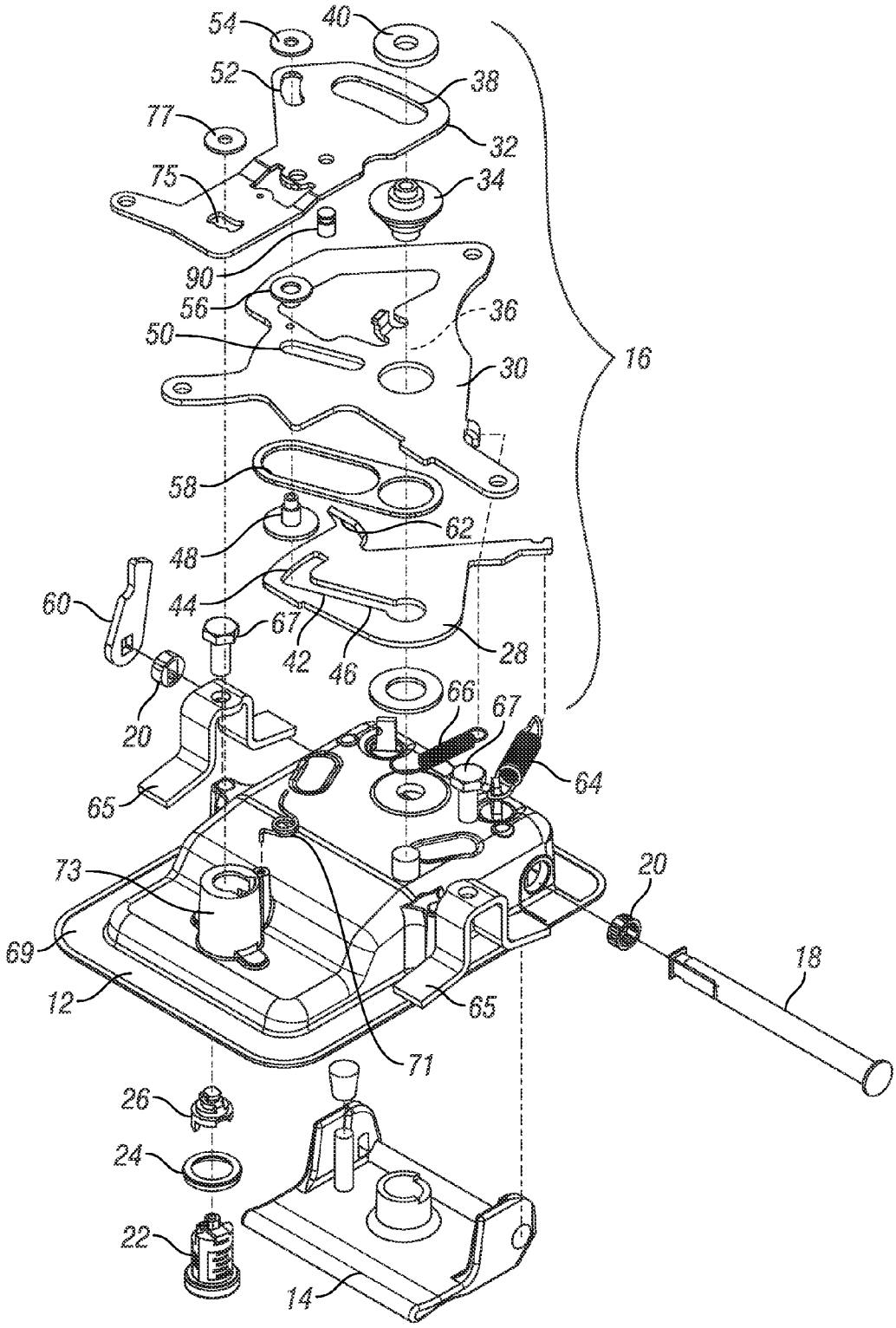
FIG. 6 is an exploded perspective view showing the components of the handle assembly.

The paddle 14 is mounted to the front or exterior side of the housing 12 with an elongated pin or axle 18, and appropriate bushings 20. The housing 12 also includes a lock cylinder 22, with a seal 24 and an actuator 26, as best seen in FIG. 6. The lock cylinder rotates in opposite directions from a home or neutral position to lock and unlock positions.

The logic assembly 16 has three primary components: a drive plate 28, a driven plate 30, and a lock arm 32. The drive plate 28 and driven plate 30 are pivotally mounted to the housing 12 via a rivet 34 which defines a pivot axis 36. The lock arm 32 includes a slot 38 through which the rivet 34 extends. A retaining washer 40 is retained by a stake or swedging on the rivet 34 so as to retain the lock arm 32, while allowing the lock arm 32 to slide or move relative to the rivet 34 via the slot 38.

The drive plate 28 includes an L-shaped slot 42 having a float leg 44 and a drive leg 46. As seen in FIG. 6, a pin 48 extends through the slot 42, through a corresponding slot 50 in the driven plate 30 and an arcuate slot 52 in the lock arm 32. A bushing 56 is provided on the pin 48 between the driven plate 30 and the lock arm 32. A washer 54 is retained by stake or swedge on the end of the pin 48 on the outside of the lock arm 32. An enlarged washer or spacer 58 resides between the drive plate 28 and the driven plate 30, and includes a hole to receive the rivet 34 and an enlarged slot through which the pin 48 extends.

A drive arm 60 is mounted on an end of the pin or axle 18 of the paddle 14, and resides on the exterior of the housing 12. The free end of the drive arm 60 engages a tab 62 on the drive plate 28.

A spring 64 has a first end connected to the housing 12 and a second end connected to the drive plate 28. A second spring 66 has a first end connected to the housing 12 and a second end connected to the driven plate 30. The springs 64, 66 bias the drive plate 28 and driven plate 30, respectively, to a neutral or de-actuated position when the paddle 14 is in the closed position.

A pair of brackets 65 are secured with the bolts 67 to the housing 12 with the door skin sandwiched between the brackets 65 and the perimeter flange 69 of the housing 12, so as to mount the handle assembly 10 to the door.

An over center spring 71 has opposite ends secured to the lock cylinder sleeve 73 on the back of the housing 12 and to the lock arm 32. The actuator 26 of the lock cylinder 22 extends through a butterfly drive slot 75 on the lock arm with a washer 77 staked or swedged to the end of the actuator 26. The spring 71 biases the lock arm 32 to the fully locked or fully unlocked positions, the lock arm 32 has lost motion via the butterfly slot 75, such that it allows the lock cylinder 22 to return to its home position for key removal, while the lock arm 32 remains biased in the locked or unlocked position, as is conventional in the art.

Figure 3:
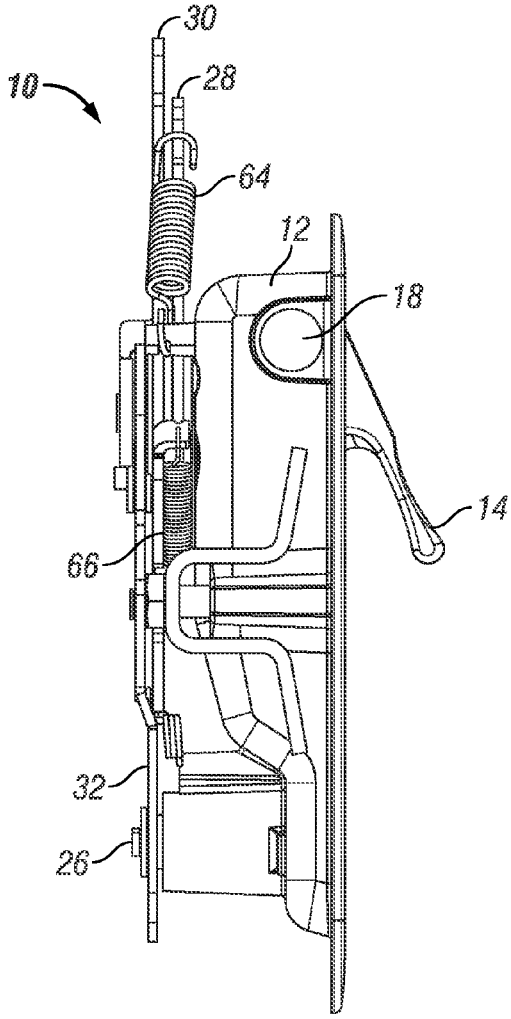
FIG. 3 is a side elevation view similar to FIG. 2, with the paddle being in an open position.
Figure 4:
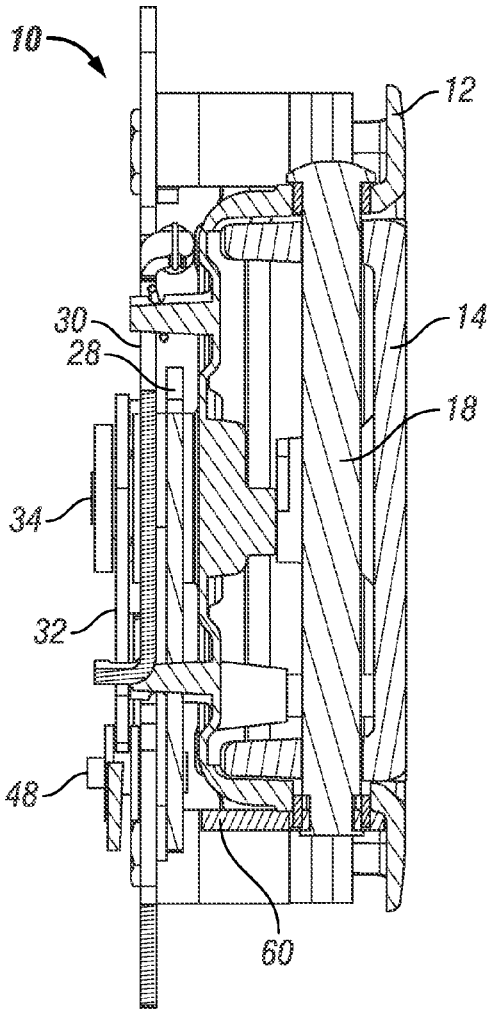
FIG. 4 is a sectional view of the handle assembly taken along lines 4-4 of FIG. 1.
Figure 5:
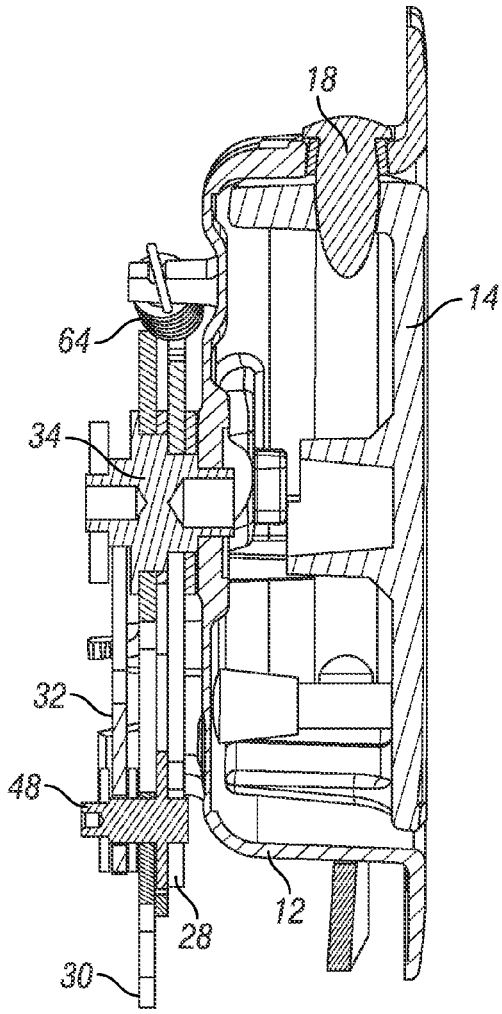
FIG. 5 is a sectional view taken along lines 5-5 of FIG. 7.
Figure 8:
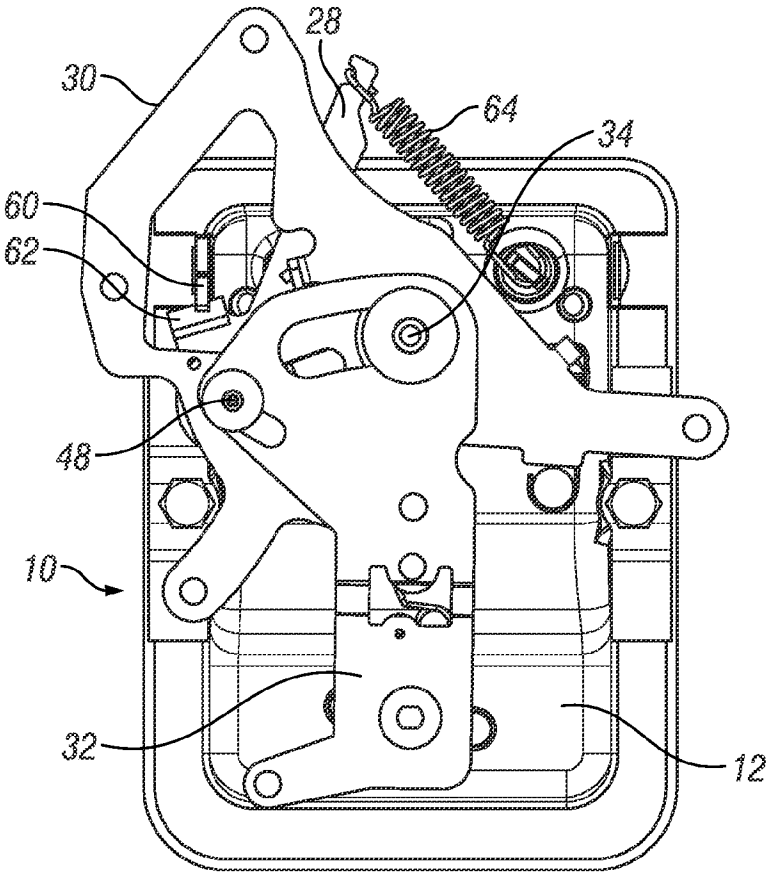
FIG. 8 is a rear elevation view showing the logic assembly when the handle assembly is locked and the paddle is in the free floating open position.
Figure 7:
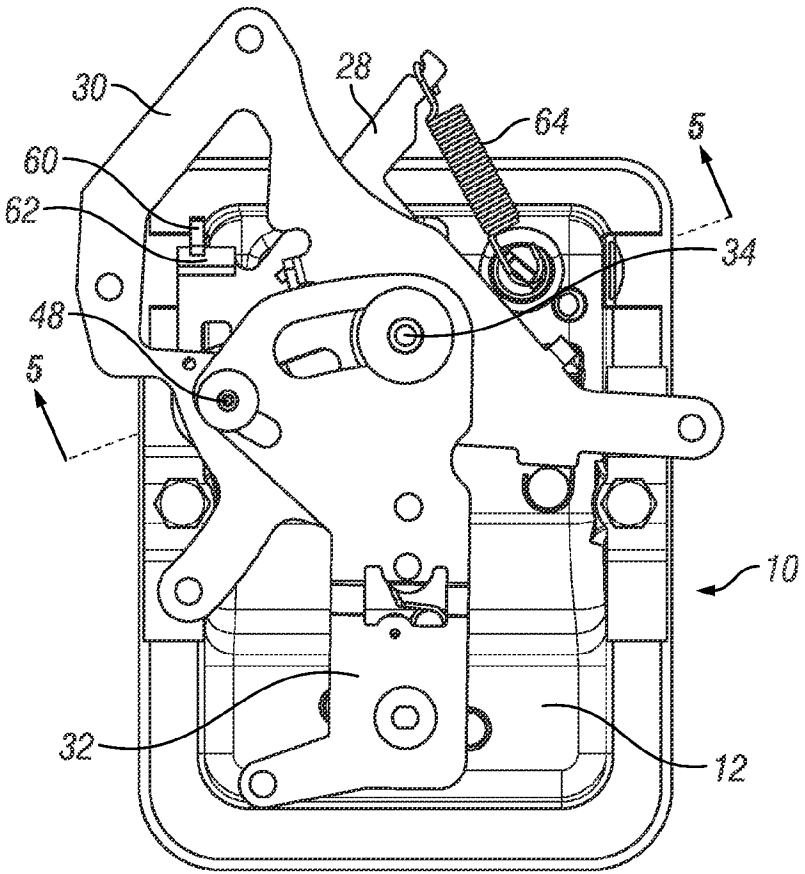
FIG. 7 is a rear elevation view of the handle assembly in a locked condition and the paddle in a closed position.

The handle assembly 10 has two operating modes: locked and unlocked. When the lock cylinder 22 is rotated to the locked position and back to the home position, and the paddle 14 is in the closed position, the components of the logic assembly 16 are positioned, as shown in FIG. 7. More particularly, the lock arm 32 is pivoted about the actuator 26 of the lock cylinder 22 so that the rivet 34 is at the right-hand end of the slot 38. This position of the lock arm 32 orients the pin 48 in the float leg 44 of the slot 42 in the drive plate 28. Accordingly, when the paddle 14 is pulled by a person to the open position shown in FIG. 3, the drive plate 28 rotates about the rivet 34, with the pin 48 moving along the float leg 44 of the slot 42, but without any action on the driven plate 30, as seen in FIG. 8. Thus, when the lock arm 32 is locked, the paddle 14 free floats. When the paddle 14 is released, the spring 64 pulls the drive plate 28 back to the neutral position, shown in FIG. 7.

Figure 10:
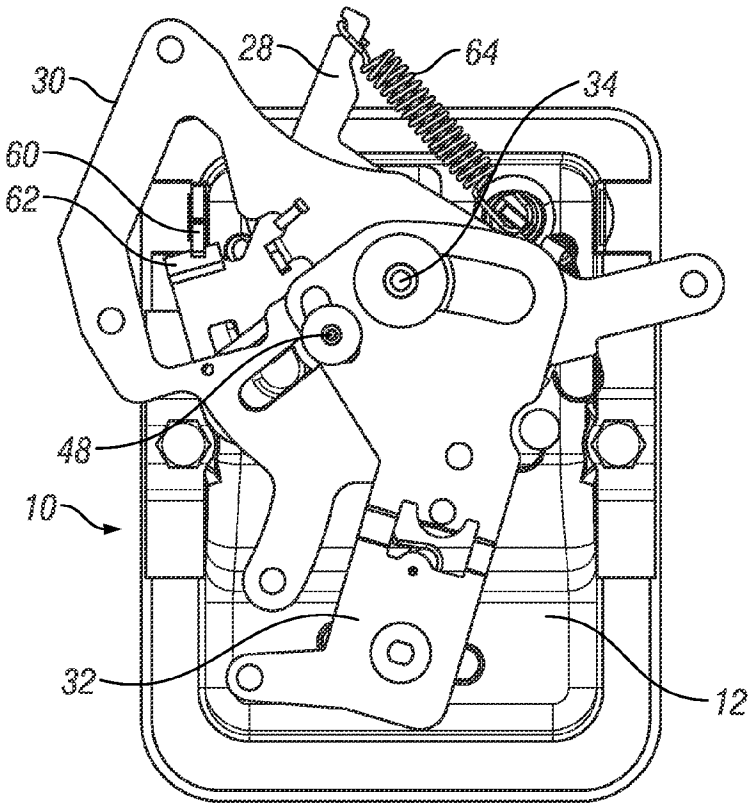
FIG. 10 is a rear elevation view showing the handle assembly in the unlocked position and the paddle moved to an open or maximum travel position.
Figure 9:
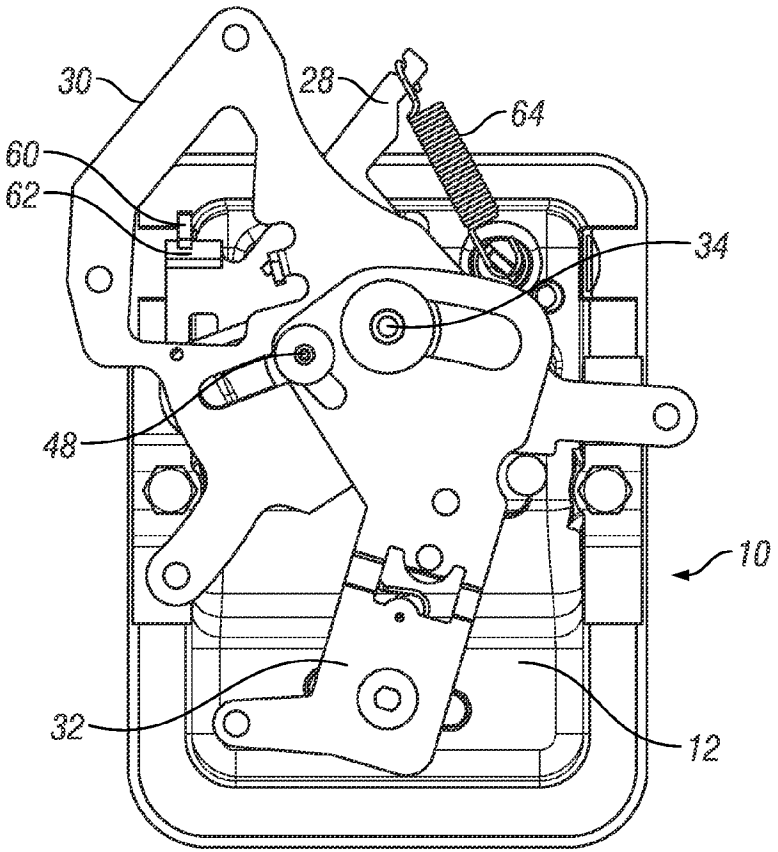
FIG. 9 is a rear elevation view showing the logic assembly in an unlocked position, with the paddle in a closed position.

When the lock cylinder 22 is rotated to the unlocked position and back to the home position, the actuator 26 pivots the lock arm 32 to the position shown in FIG. 9, with the rivet 34 located at the left-hand end of the slot 38, and moving the pin 48 to the drive leg 46 of the slot 42 in the drive plate 28. Now, when the paddle 14 is pulled to the open position, the drive arm 60 pushes the tab 62 so as to rotate the drive plate 28 about the rivet 34, which in turn also rotates the driven plate 30 about the rivet 34 via the pin 48. The rotated positions of the drive plate 28 and driven plate 30 when the paddle 14 is pulled to the open position are shown in FIG. 10. When the paddle 14 is released, the springs 64, 66 bias the drive plate 28 and driven plate 30, respectively, to the neutral position, shown in FIG. 9.

Thus, when the lock cylinder 22 is rotated to the lock position and back to the home position, the lock arm 32 is in the lock position and the drive plate 28 moves independently of the driven plate 30 when the paddle 14 is pulled to the open position. When the lock cylinder 22 is rotated to the unlock position and back home, the lock arm 32 is in the unlocked position, and the drive plate 28 and drive plate 30 move in unison upon actuation of the paddle to the open position. When the vehicle door is locked, the paddle 14 free floats with no effect. When the door is unlocked, the paddle 14 will open the latch when pulled open.

The lock arm 32 has a range of motion of approximately 15° between the locked and unlocked positions. The drive plate 28 and the driven plate 32 have a range of motion of approximately 20°.

Figure 11:
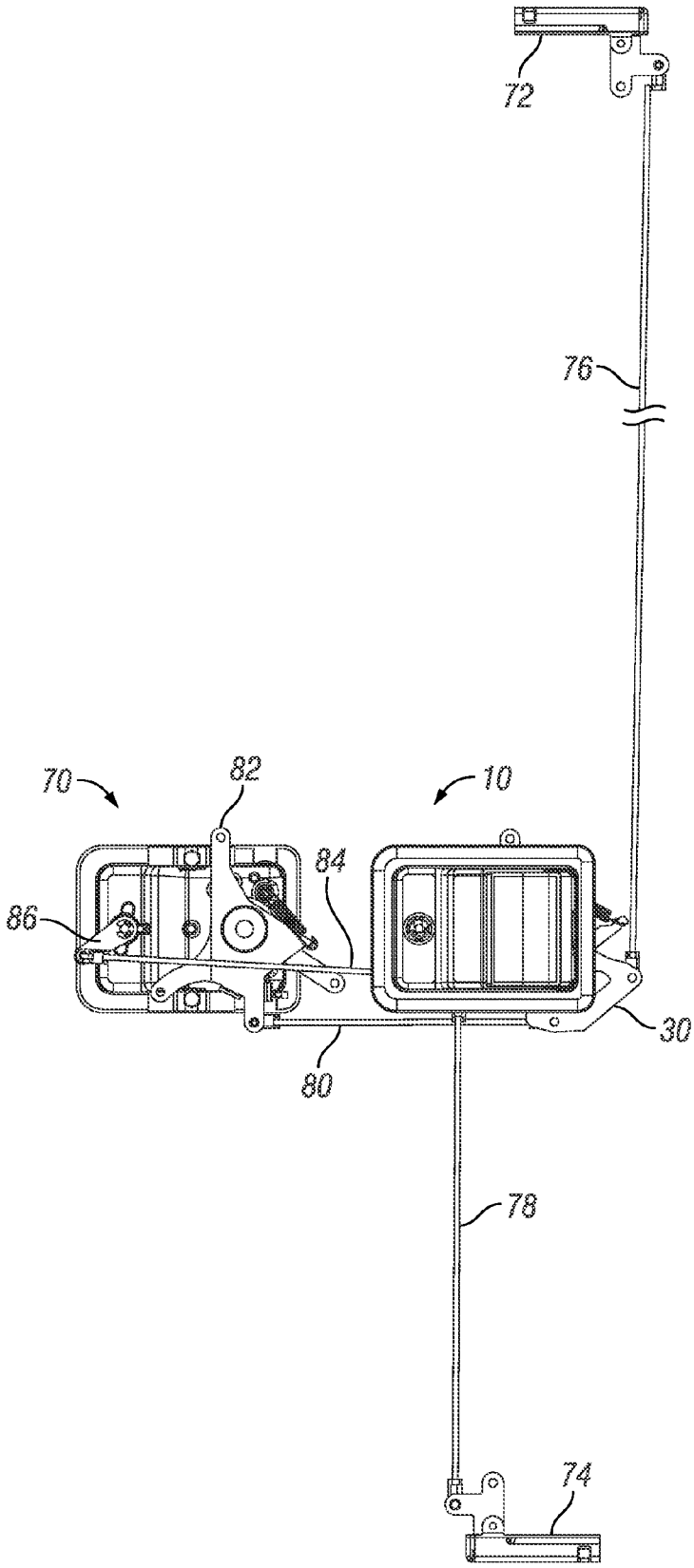
FIG. 11 is an outside schematic view showing the exterior paddle handle assembly of the present invention in conjunction with an interior paddle assembly, with both assemblies being linked to upper and lower latch mechanisms.
Figure 12:
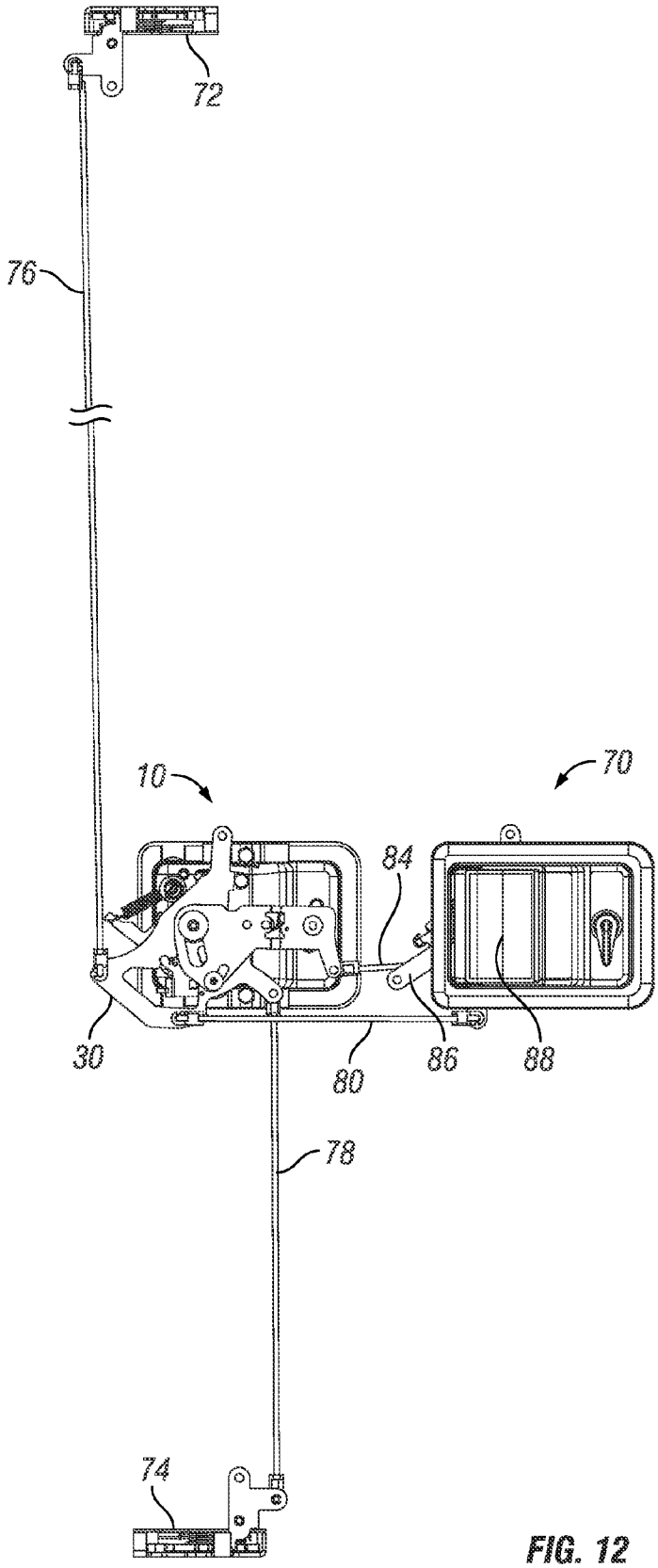
FIG. 12 is an inside schematic view showing the exterior paddle handle assembly of the present invention in conjunction with an interior paddle assembly, with both assemblies being linked to upper and lower latch mechanisms.
Figure 13:
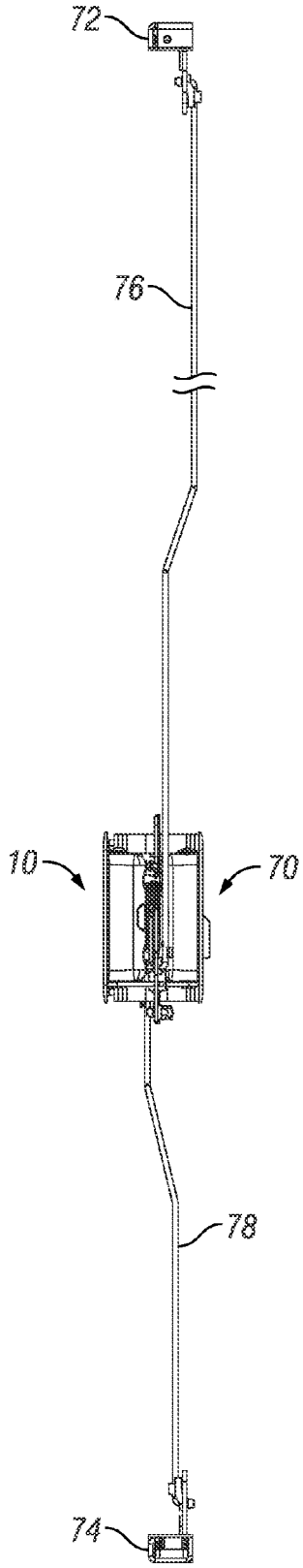
FIG. 13 is a schematic view from the door edge showing the interior and exterior handle assemblies, upper and lower latches, and linkage arms.

FIGS. 11-13 show the linkages between the outside handle assembly 10, an inside handle assembly 70, an upper latch mechanism 72, and a lower latch mechanism 74. More particularly, a first linkage rod 76 extends between the driven plate 30 and the upper latch 72. A second linkage rod 78 extends between the driven plate 30 and the lower latch 74. A third linkage arm 80 extends between the driven plate 30 and an actuation plate 82 of the inside handle assembly 70. A fourth linkage arm 84 extends between the lock arm 32 and a lock lever 86 of the inside handle assembly 70.

The inside handle assembly 70 includes a paddle 88 which is movable between closed and opened positions. When the lock arm 32 of the outside handle assembly 10 is locked, a person inside the vehicle can move the paddle 88 from the closed to the open position, which causes the fourth link arm 84 to pivot the lock arm 32 to the unlocked position, while the third linkage arm 80 pivots the driven plate 30 so that the linkage arms 76, 78 open the upper and lower latches 72, 74. When the interior paddle 88 is pulled, the plate 82 rotates to push a pin 90 attached to the lock arm 32 of the logic assembly 16 so as to pivot the lock arm 32 from the locked to the unlocked position. Thus, the inside handle assembly 70 overrides the outside handle assembly 10 when a person inside the vehicle wants to open the vehicle door.

It is understood that the inside paddle 88 is normally biased to the closed position. Similarly, the inside actuation plate 82 is normally biased to a neutral position. Also, it is understood that the handle assemblies 10, 70 can be used in a vehicle having only one upper or lower latch, and does not require both an upper and lower latch. Also, an inside handle assembly is not used on non-passenger vehicle compartments.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A paddle handle assembly for a vehicle having a latch movable between open and closed positions, comprising;

a housing having interior and exterior sides;

a paddle pivotally mounted on the exterior side of the housing for movement between open and closed positions;

a logic assembly on the interior side of the housing;

the logic assembly including:

a drive plate pivotally mounted on the housing;

driven plate pivotally mounted on the housing and being connected to the latch;

a lock arm pivotally mounted on the housing for movement between locked and unlocked positions;

a drive arm connected to the paddle via a drive axle and engaging the drive plate, and moving the drive plate from a first position to a second position when the paddle is moved from the closed position to the open position;

the drive plate being disengaged from the driven plate when the lock arm is in the locked position, such that the latch remains in the closed position when the paddle is moved to the open position;

the drive plate being engaged with the driven plate when the lock arm is in the unlocked position so that the latch is moved to the open position when the paddle is moved to the open position;

a pivot pin extending from the housing and extending through the drive plate, the driven plate and the lock arm; and the driven plate and the driven plate being pivotally mounted on the pivot pin, and the lock arm has a slot to receive the pivot pin.

2. The paddle handle assembly of claim 1 further comprising a drive pin extending through the drive plate, the driven plate and the lock arm.

3. The paddle handle assembly of claim 2 wherein the driven plate has a slot along which the drive pin moves when the lock arm moves between the locked and unlocked positions.

4. The paddle handle assembly of claim 3 wherein the drive plate includes an L-shaped slot having a float leg and a drive leg, and the drive pin residing in the float leg when the lock arm is in the locked position, and the drive pin residing in the drive leg when the lock arm is in the unlocked position.

5. The paddle handle assembly of claim 4 wherein the driven plate slot has opposite ends aligned with the float leg and drive leg, respectively, of the drive plate L-shaped slot.

6. The paddle handle assembly of claim 4 wherein the lock arm has a slot for receiving the drive pin and through which the drive pin moves when the lock arm is in the unlocked position and the paddle is moved to the open position.

7. The paddle handle assembly of claim 1 wherein the drive plate is spring biased to urge the paddle to the closed position.

8. A paddle handle assembly for a vehicle having a latch movable between open and closed positions, comprising:

a housing having opposite interior and exterior sides;

a paddle pivotally mounted on the exterior side of the housing for movement between open and closed positions;

a logic assembly on the interior side of the housing;

the logic assembly including:

a drive plate pivotally mounted on the housing;

a driven plate pivotally mounted on the housing and being connected to the latch;

a lock arm pivotally mounted on the housing for movement between locked and unlocked positions;

whereby movement of the paddle to the open position moves the drive plate independently of the driven plate when the lock arm is in the locked position such that the latch remains in the closed position; and whereby movement of the paddle to the open position moves the drive plate and driven plate in unison when the lock arm is in the unlocked position such that the latch is moved to the open position;

a pivot pin extending from the housing and extending through the drive plate, the driven plate and the lock arm; and the drive plate and the driven plate being pivotally mounted on the pivot pin, and the lock arm has a slot to receive the pivot pin.

9. The paddle handle assembly of claim 8 further comprising a drive arm connected to the paddle and engaging the drive plate, and moving the drive plate from a first position to a second position when the paddle is moved from the closed position to the open position.

10. The paddle handle assembly of claim 8 further comprising a drive pin extending through aligned slots in the drive plate, the driven plate and the lock arm.

11. The paddle handle assembly of claim 10 wherein the drive plate slot has a float leg and a drive leg, with the drive pin being received in the float leg when the lock arm is in the locked position so as to disengage the drive plate from the driven plate and lock arm, and the drive pin being received in the drive leg when the lock arm is in the unlocked position so as to engage the drive plate with the driven plate and the lock arm.

12. The paddle handle assembly of claim 8 wherein the paddle is biased to the closed position.

13. The paddle handle assembly of claim 8 wherein the housing, paddle and logic assembly are an outside handle assembly for use on an exterior of a vehicle door, and further comprising an inside handle assembly operatively connected to the latch and to the outside handle assembly to open the door from inside the vehicle.

14. The paddle handle assembly of claim 13 wherein the inside handle assembly overrides the outside handle assembly.

15. The paddle handle assembly of claim 13 wherein the inside handle assembly is connected to the driven plate by a first link arm and is connected to the lock arm by a second link arm.

* * * * *

UNITED STATES PATENT AND TRADEMARK OFFICE

CERTIFICATE OF CORRECTION

PATENT NO. : 8,579,337 B2
APPLICATION NO. : 12/693778
DATED : November 12, 2013
INVENTOR(S) : Matthew L. Hidding It is certified that error appears in the above-identified patent and that said Letters Patent is hereby corrected as shown below:

In the Claims:

Col. 4, Claim 1, Line 67:
ADD before driven --a--

Col. 5, Claim 1, Line 16:
DELETE before being "the driven plate and the driven plate"
ADD before being --the drive plate and the driven plate--

Signed and Sealed this
Seventh Day of January, 2014

Margaret A. Focarino

Margaret A. Focarino
*Commissioner for Patents of the United States Patent and Trademark Office*